US006387296B1

(12) United States Patent
Eckstein et al.

(10) Patent No.: US 6,387,296 B1
(45) **Date of Patent: *May 14, 2002**

(54) OPTICALLY BRIGHTENED PLASTICS FOR OPTICALLY BRIGHTENING PAPER-COATING COMPOUNDS AND PAPER-COATING COMPOUNDS OPTICALLY BRIGHTENED IN THIS MANNER

(75) Inventors: Udo Eckstein, Köln; Joachim König, Odenthal; Fritz Puchner, Köln; Ulrich Feldhues, Bergisch Gladbach; Matthias Köcher, Köln; Uwe Vogt, Monheim; Eckhard Wenderoth, Leverkusen, all of (DE)

(73) Assignee: Bayer Aktiengesellschaft, Leverkusen (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/860,503

(22) PCT Filed: Dec. 27, 1995

(86) PCT No.: PCT/EP95/05133

§ 371 Date: Jun. 27, 1997

§ 102(e) Date: Jun. 27, 1997

(87) PCT Pub. No.: WO96/21062

PCT Pub. Date: Jul. 11, 1996

(30) Foreign Application Priority Data

Jan. 5, 1995 (DE) ..... 195 00 195

(51) Int. Cl.[7] ..... C09K 11/06

(52) U.S. Cl. ..... 252/301.21; 252/301.32; 524/86; 524/87; 524/89; 524/92; 524/94; 524/565

(58) Field of Search ..... 524/86, 87, 89, 524/91, 92, 94, 565; 428/147, 211, 326, 509, 511, 512, 513; 252/301.21, 301.32

(56) References Cited

U.S. PATENT DOCUMENTS

| | | | | | |
|---|---|---|---|---|---|
| 3,047,390 | A | | 7/1962 | Koerber et al. | 96/82 |
| 3,625,952 | A | * | 12/1971 | Schellhammer | 252/301.2 W |
| 3,684,764 | A | * | 8/1972 | Buell | 524/95 |
| 3,696,097 | A | * | 10/1972 | Schlapfer | 252/301.2 W |
| 3,890,305 | A | * | 6/1975 | Weber et al. | 106/124.8 |
| 3,926,963 | A | * | 12/1975 | Meyer | 252/301.2 |
| 3,950,376 | A | | 4/1976 | Feit et al. | 424/263 X |
| 4,005,098 | A | | 1/1977 | Dorlars et al. | 260/308 |
| 4,055,565 | A | * | 10/1977 | Hotta et al. | 252/301.2 |
| 4,189,589 | A | * | 2/1980 | Meyer et al. | 252/301.25 |
| 4,326,066 | A | * | 4/1982 | Eckstein et al. | 548/256 |
| 4,374,643 | A | * | 2/1983 | Suzuki et al. | 252/301.21 |
| 4,386,965 | A | | 6/1983 | Fringeli et al. | 106/214 |
| 4,405,751 | A | | 9/1983 | Müller et al. | 524/720 |
| 4,572,893 | A | * | 2/1986 | Asao | 430/532 |
| 4,609,591 | A | * | 9/1986 | Pollet et al. | 428/391 |
| 4,654,261 | A | * | 3/1987 | Takayanagi et al. | 428/336 |
| 4,717,502 | A | | 1/1988 | Schmid | 252/301.23 |
| 4,745,195 | A | * | 5/1988 | Kaneoya et al. | 524/91 X |
| 4,870,164 | A | * | 9/1989 | Kuhne et al. | 106/447 |
| 4,888,128 | A | | 12/1989 | Koll et al. | 252/301.23 |
| 4,898,773 | A | * | 2/1990 | Dethlefs et al. | 428/332 |
| 5,059,580 | A | * | 10/1991 | Shibata et al. | 503/227 |
| 5,106,989 | A | * | 4/1992 | Kubbota et al. | 548/220 |
| 5,213,888 | A | * | 5/1993 | Kubbota et al. | 428/328 |
| 5,302,576 | A | * | 4/1994 | Tokiyoshi et al. | 503/227 |
| 5,317,048 | A | * | 5/1994 | Tarbit et al. | 524/94 |
| 5,340,854 | A | * | 8/1994 | Martic et al. | 524/94 |
| 5,362,614 | A | * | 11/1994 | Serizawa et al. | 430/538 |

FOREIGN PATENT DOCUMENTS

| | | |
|---|---|---|
| DE | B-1108560 | 6/1961 |
| DE | B-1149244 | 5/1963 |
| EP | 0074590 | 3/1983 |
| EP | A-0274666 | 7/1988 |
| EP | A-0409028 | 1/1991 |
| GB | 1294173 | 10/1972 |
| GB | 1349934 | 4/1974 |

OTHER PUBLICATIONS

H.G. Oesterlin, Optische Aufhellung gestrichener Papiere unter Mitwirkung von Polyvinylalkohol, 36, Jahrgang, Heft 2, pp. 66–72, (1982).

Abstract of EP–A–0074590 and claim 1.

Kirk Othmer: Encyclopedia of Chem. Technology, vol. 4(3rd edition) pp. 213–225 (1978).

* cited by examiner

*Primary Examiner*—Judy M. Reddick
(74) *Attorney, Agent, or Firm*—Norris McLauglin & Marcus

(57) ABSTRACT

Paper coating slips having high whiteness, high greying limit and high lightfastness can be prepared with the aid of whitened finely divided plastics.

2 Claims, No Drawings

OPTICALLY BRIGHTENED PLASTICS FOR OPTICALLY BRIGHTENING PAPER-COATING COMPOUNDS AND PAPER-COATING COMPOUNDS OPTICALLY BRIGHTENED IN THIS MANNER

The invention relates to the use of whitened finely divided plastics for whitening paper coating slips based on synthetic binders, and paper coating slips which contain such whitened plastics.

Aqueous coating slips based on polymeric binders are used in very large amounts for the production of coated papers and boards. Customary binders for paper coating slips comprise, for example, butadiene/styrene, styrene/butyl acrylate, acrylonitrile/butadiene/styrene, styrene/butadiene/alkyl acrylate, alkyl acrylate, ethylene/vinyl chloride and ethylene/vinyl acetate copolymers and the homopolymers polyethylene, polyvinyl chloride, polyvinylidene chloride, polyvinyl acetate and polyaddition compounds such as polyurethanes.

In addition to the customary white pigments—especially china clay and calcium carbonate—the coating slips contain as a rule, for optical brightening, anionic whiteners, for example those of the bis-triazinyl-aminostilbene-disulphonic acid type. However, these whiteners lead only to very unsatisfactory whitening effects and to very low greying limits (=whitener concentration at which further addition of whitener produces no increase, or even a decrease, in the whiteness). In addition, the stated whitener types have insufficient lightfastness in the coating slips.

It has already been recommended that the whitening effect in coating slips can be improved by using hydrophilic cobinders or carriers ("Das Papier" 36 (1982) 66; German Offenlegungsschrift 3,502,038, EP-A 4 37 90). However, the water sensitivity of the coated paper is increased to an undesirable extent by the hydrophilic character of the components added.

It has also been proposed to use dispersion brighteners in the presence of dispersants (British Patent Specifications 1,294,273 and 1,349,934). The whiteness achievable and the strong dependence of the whiteness on the drying temperature may, however, be unsatisfactory.

Water-soluble whiteners have also already been condensed with aminoplasts and these condensates are recommended in particular for whitening paper coating slips (German Offenlegungsschrift 3,112,435). However, these proposals have not become established in practice, owing to insufficient lightfastness and rheological difficulties.

The production of coated papers and boards having a high degree of whiteness, a high greying limit and good lightfastness is a difficult problem which has not been solved satisfactorily to date.

It has now been found, surprisingly, that whitened finely divided plastics which are not aminoplasts impart very high levels of whiteness, high greying limits and high lightfastnesses to paper coating slips.

The invention therefore relates to the use of whitened finely divided plastics from the series comprising polyacrylonitrile, polyamide, polyester, polyolefins, vinylaromatic polymers and cellulose or regenerated celluloses for whitening paper coating slips based on synthetic binders.

The invention furthermore relates to paper coating slips whitened with the aid of these whitened plastics.

The plastics on which the whitened plastics to be used according to the invention are based comprise polyacrylonitriles, polyamides, such as, for example, polyamide 6 and polyamide 6.6, and polyesters, in particular those based on phthalic acid, isophthalic acid and/or terephthalic acid and ethylene glycol, 1,4-butanediol and/or bis (hydroxymethyl)-cyclohexane, polyesters based on maleic acid and/or fumaric acid and/or p-phenylenediacetic acid and/or 4,4'-diphenyldicarboxylic acid and/or 2,6-naphthalenedicarboxylic acid and ethylene glycol, polyesters based on 4-hydroxybenzoic acid, polyolefins, such as polyethylene and polypropylene, vinylaromatic polymers, such as polystyrene, cellulose and regenerated celluloses, such as viscose and acetylcellulose (in particular cellulose di- and triacetate).

Preferred polyacrylonitriles have intrinsic viscosities (measured in dimethylformamide at 20° C.) of from 1.18 to 2.22 dl/g, preferred polyamides have relative viscosities (measured in a 1% strength by weight solution in m-cresol at 25° C. using an Ubbelohde viscometer) of from 2 to 5.5, preferably from 2 to 4, and preferred polyesters have intrinsic viscosities (measured in phenol/tetrachloroethane=60:40 (parts by weight) at 25° C.) of from 0.4 to 1.5 dl/g.

For the purposes of the invention, plastics powders having a particle size (determined as weight average) of less than 1 $\mu$m are referred to as "finely divided".

The person skilled in the art can base his choice of preferred whiteners on the optical brighteners which are used for whitening in the textile sector. On textile fibres, preferred whiteners give comparatively high lightfastnesses—measured in the Xenotest on the basis of the guidelines for the determination of colour fastnesses according to DIN 54004—of at least 4, preferably from 5 to 7.

Preferably used whiteners for finely divided polyacrylonitriles are compounds of the formulae:

(1)

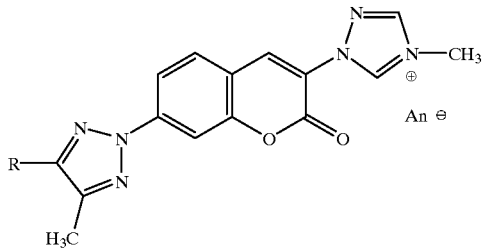

in which

R denotes ethyl or phenyl;

(2)

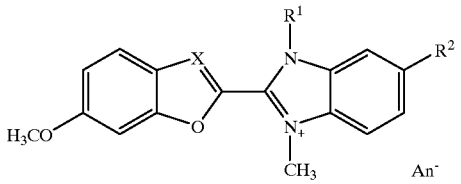

in which x represents CH or N, $R^1$ represents $CH_3$ or $CH_2$—$C_6H_5$ and $R^2$ represents H or $SO_2$—$CH_3$; and (3)

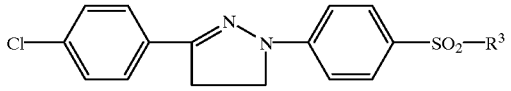

in which $R^3$ denotes $NH_2$, $CH_3$, NH—$C_3H_6$—$N(CH_3)_3^+An^-$, $C_2H_4$—$N(CH_3)_3^+An^-$, $CH_2$—$CH(CH_3)$—$N(CH_3)_3^+An^-$, $CH(CH_3)$—$CH_2$—$N(CH_3)_3^+An^-$, $C_2H_4$—O—$CH(CH_3)$—$CH_2$—$N(CH_3)_3^+An^-$ or $C_2H_4$—CO—NH—$C_3H_6$—$N(CH_3)_3^+An^-$ and $An^-$ denotes the anion of a mineral acid, formic acid, acetic acid, lactic acid or $^{-O}{}_3SOCH_3$.

Preferably used whiteners for finely divided polyamides are compounds of the formulae (4)

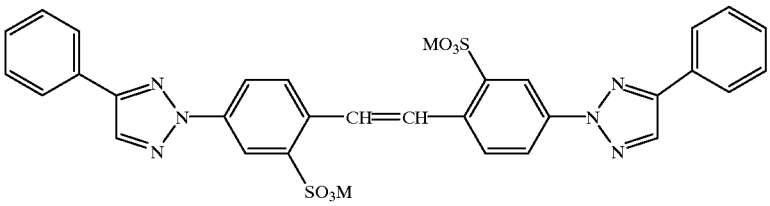

and (5)

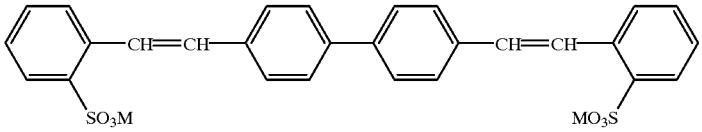

in which

M represents an alkali metal or hydrogen.

Preferably used whiteners for finely divided polyesters are compounds of the formulae (6)

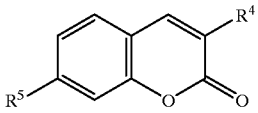

in which $R^4$ denotes phenyl or a radical of the formula

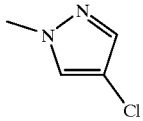

and $R^5$ denotes a radical of the formula

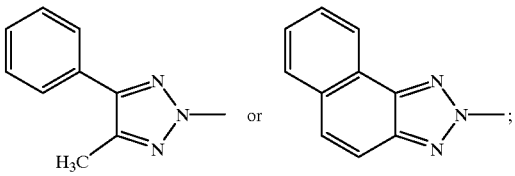

(7)

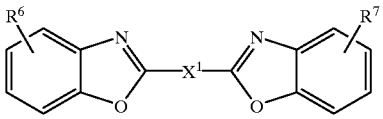

in which $R^6$ and $R^7$, independently of one another, denote hydrogen, $C_1$–$C_4$-alkyl or $C_1$–$C_4$-alkoxycarbonyl and $X^1$ represents —CH═CH—,

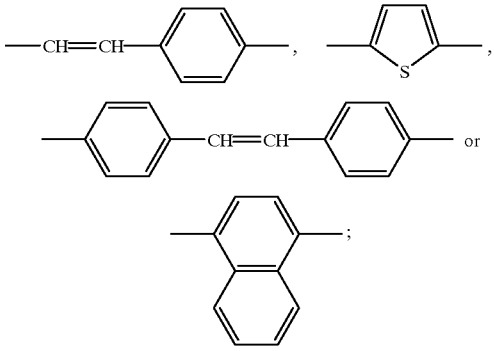

(8)

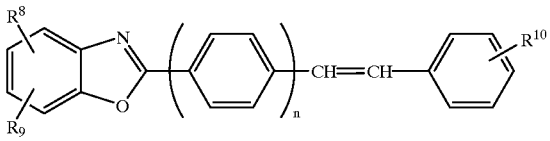

in which $R^8$ and $R^9$, independently of one another, denote hydrogen or $C_1$–$C_4$-alkyl, $R^{10}$ denotes $C_1$–$C_4$-alkyl, phenyl or $C_1$–$C_4$-alkoxycarbonyl n denotes 0 or 1;

(9)

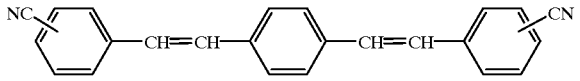

in which the CN groups may each be in the o-, p- or m-position, and their isomer mixtures; and (10)

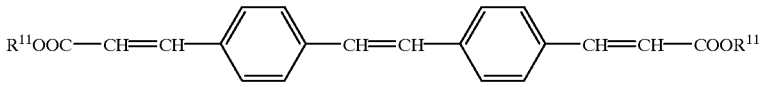

in which $R^{11}$ denotes $C_1$–$C_4$-alkoxy-carbonyl.

Very particularly preferred whitened plastics contain whitened polyacrylonitrile with whiteners of the formulae (1) or (2), whitened polyamide with whiteners of the formula (5) or whitened polyesters with whiteners of the formulae (6) or (7).

The finely divided whitened plastics can be incorporated in powder form into the paper coating slips. In most cases, however, it is likely to be more convenient to disperse the finely divided plastics in the aqueous phase before or after the application of the whitener and, after the whitener has been applied if appropriate, to incorporate the aqueous plastics dispersion obtained into the paper coating slips.

These plastics dispersions may contain A) from 1 to 30% by weight, preferably from 5 to 25% by weight, of the whitened polymers, B) from 1 to 50% by weight, preferably from 5 to 20% by weight, of surface-active substances, C) from 0 to 15% by weight of preservatives and D) from 20 to 98% by weight, preferably from 55 to 90% by weight, of water, it being possible to replace up to half the water by hydrotropic substances, such as, for example, ethylene glycol or glycerol, the stated percentages being relative to the sum A+B+D in each case.

The surface-active substances used may be anionic, cationic and/or nonionic surface-active substances, as described, for example, in Methoden der Organischen Chemie [Methods of Organic Chemistry] (Houben-Weyl), 4th Edition, Vol. XIV/I, Georg Thieme Verlag, Stuttgart 1961, page 190 et seq., and in German Offenlegungsschrift 2,334, 769, pages 8 to 10 (▲ British Patent Specification 1,417, 071). Dispersions of the finely divided whitened plastics to be used according to the invention may be prepared, for example, as follows:

First, the pulverulent polymers are treated with the whiteners suitable for the selected substrate, in aqueous systems at temperatures of from 60° C. to the boiling point, until the whiteners have been completely applied to the substrate. If appropriate, further auxiliaries are used.

The whiteners can, however, also be fixed on the corresponding polymer materials in the fusion process.

The amount of whiteners used on the substrate depends on the desired brightening effect; it is between 0.01 and 5% by weight of pure active substance, relative to the plastic (solid) used.

The whitened plastic powder isolated is then homogenized with vigorous stirring, after the addition of a surface-active substance and optionally water. Thereafter, the amount of surface-active substance can be increased, optionally to the total amount required for the stability of the dispersion. The suspension obtained is then precomminuted and wet-milled. The precomminution can be effected by means of stone mills or toothed colloid mills. The subsequent wet comminution can be effected in colloid mills, vibratory mills, conical mills and vibromills and in dissolvers or in sub-micro dispersers. However, continuous stirred ball mills containing grinding media, preferably those comprising $SiO_2$ of from 0.2 to 5 mm diameter, are preferably used.

After the milling treatment, further amounts of surface-active substances or hydrotropic substances, preservatives, wetting agents, antifoams and/or water may also optionally be added, unless this has already been done at an early stage, for example before the milling.

The whitened plastics powder isolated can, however, also be incorporated directly into the paper coating slips after dry milling.

A particularly advantageous possibility for the preparation of a dispersion of whitened plastic is the combination of the whitener application process and the milling process:

For this purpose, the pulverulent plastic, together with the corresponding whitener, water and surface-active substances, is wet-comminuted as described above at temperatures from 60° C. to the boiling point, optionally after homogenization and precomminution. Complete brightening takes place during the milling process in the milling apparatus, preferably in a continuous stirred ball mill containing $SiO_2$ grinding media.

The amount of whiteners used in the paper coating slip depends on the desired whitening effect. In general, from 0.01 to 0.5% by weight of pure whiteners (relative to the solid of the paper coating slip to be brightened) is sufficient. A particular advantage is that, depending on the coating slip composition, the achievable greying limit is extremely high.

The paper coating slips have in general solids contents of from 35 to 80, preferably from 40 to 70,% weight. In addition to the whitened finely divided plastic to be used according to the invention, they contain in general (data relative in each case to solid)

a) from 100 to 150 parts by weight of inorganic pigment, b) from 3 to 25 parts by weight of binder, of which up to a half optionally consists of natural (that is to say nonsynthetic) cobinder (such as, for example, starch, casein), c) up to 1 part by weight of thickener and d) up to 2 parts by weight of wet strength agent.

The stated percentages in the examples below relate in each case to weight; parts are parts by weight.

EXAMPLES

Example 1

Whitened Polyacrylonitrile 100 g of polyacrylonitrile powder (®Dralon RK, Bayer AG) are suspended in 1 l of demineralized water. The pH is adjusted to 2.5 with formic acid. At 60° C., 0.2, 0.5, 1 or 1.5% of whitener of the formula (1) (R=ethyl and An=$^{-}SO_3OCH_3$) are added and the mixture is heated to the boiling point. The mixture is then stirred for 20–40 min at 98° C. Filtration with suction is carried out at 60° C. and the whitened powder is dried at 40° C. in a vacuum drying oven. The whitened powders show the following whitenesses:

TABLE 1

| Example 1 | Whitener conc. in % | Whiteness Berger | Whiteness CIE |
|---|---|---|---|
| a) | 0.2 | 147.4 | 138.9 |
| b) | 0.5 | 157.4 | 145.2 |
| c) | 1 | 161.9 | 151.5 |
| d) | 1.5 | 169.3 | 151.5 |

Example 2

Dispersion of Whitened Polyacrylonitrile 188 g of the whitened polyacrylonitrile powder prepared according to Example 1d (1.5% of fixed whitener) are homogenized together with 140 g of dispersant (an ethoxylated nonylphenol/cyclohexylamine adduct, ®Avolan ONP 100%; Bayer) and 672 g of water, and precomminuted in a toothed colloid mill. The suspension is then wet-comminuted at room temperature by means of 4 passes in a bead mill. The resulting stable dispersion can be readily incorporated into paper coating slips and exhibits excellent whitening effects with high lightfastnesses, even with the addition of large amounts.

Example 3

Paper Coating Slip (Not According to the Invention)

By stirring together

| | |
|---|---|
| 50 | parts of china clay SPS, |
| 50 | parts of calcium carbonate (chalk), |
| 12 | parts of an anionic plastics dispersion of an acrylic ester-containing copolymer having a solids content of 48% (® Acronal S 320 D from BASF), |
| 0.5 | part of polyvinyl alcohol and |
| 80 | parts of water, |

a paper coating slip having a solids content of about 55% is prepared, the pH of said paper coating slip being adjusted to 9 with sodium hydroxide solution (coating slip 3).

Example 4 a) 150 g, b) 300 g and c) 450 g of the dispersion according to Example 2 are each incorporated into 1 kg of the coating slip according to Example 3.

For the production of coated papers, the coating slips 3 and 4 a)–c) are applied to paper with the aid of a manual doctor blade or an experimental coating unit and dried at 80° C. Table 2 shows the CIE whiteness of the papers after production and after exposure to light (1 week in daylight).

TABLE 2

| Example | Whitener concentration used, in % | CIE whiteness before exposure to light | CIE whiteness after exposure to light | Decrease in whiteness due to exposure to light |
|---|---|---|---|---|
| 3) | without whitener | 71.4 | 71 | 0.4 |
| 4a) | 0.037 | 94.4 | 93.2 | 1.5 |
| 4b) | 0.065 | 101.8 | 100.8 | 1 |
| 4c) | 0.088 | 107.4 | 106.1 | 1.3 |

Even with a very low whitener concentration, the papers according to the invention exhibit both increased whiteness and substantially improved lightfastness.

In the same way as the dispersions, corresponding amounts of whitened polyacrylonitrile powder according to Example 1 can also be incorporated directly into this coating slip.

Example 5

Whitened Polyacrylonitrile

If the procedure described in Example 1 is followed but 1% of whitener of the formula (2) (X=CH, $R^1$=methyl, $R^2$=$SO_2$—$CH_3$ and $An^{-}$=$^{-}SO_3OCH_3$) is added instead of the whitener of the formula (1) (R=ethyl and An=$^{-}SO_3OCH_3$) and working up is carried out in the manner described, polyacrylonitrile powder (Berger whiteness 156, CIE whiteness 147.6) which is likewise suitable for brightening paper coating slips and gives, in the same manner as described in Example 2, a stable dispersion which can be readily incorporated into paper coating slips and gives therein outstanding whitening effects with high lightfastness and high greying limit.

Example 6

Whitened Polyamide 8 g of sodium dithionite, 12 g of ethoxylated nonylphenol (7–10 mol of ethylene oxide) and ×g (cf. Table 3) of the brightener of the formula (4) (M=K) are suspended in 4 l of demineralized water. Heating is carried out to 80° C. and 100 g of polyamide powder (polyamide 6D, Riedel de Haen) are added in portions at this temperature. Stirring is then carried out for 30 min at the boiling point. After cooling to 80° C., the product is filtered off with suction and dried at 40° C. in a vacuum drying oven. Whitened polyamide powder having the following whiteness values is obtained:

TABLE 3

| Example 1 | Whitener conc. in % | Whiteness Berger | Whiteness CIE |
|---|---|---|---|
| a) | 0.2 | 109.6 | 111.8 |
| b) | 1 | 132.7 | 130.6 |
| c) | 2 | 154.7 | 143.7 |
| d) | 3 | 161.7 | 149.1 |

Example 7

Dispersion of Whitened Polyamide

25% of the polyamide powder whitened according to Example 6c (2% of fixed brightener), 20% of emulsifier (an ethoxylated biphenyl, emulsifier W from Bayer) and 55% of water are milled at room temperature and 1700 rpm for 90 min in a laboratory stirred ball mill filled with 290% of glass beads (0.4–0.52 mm diameter). The resulting stable dispersion can be readily incorporated in the present form into the paper coating slip.

Example 8

Paper Coating Slips

Coating slips and paper coats can be produced in the same way as described in Example 4. Instead of the pigment dispersion from Example 2, the corresponding amount of a pigment dispersion according to Example 7 is used. Table 4 shows the CIE whiteness of the papers after production and after exposure to light (1 week in daylight).

TABLE 4

| Example | Whitener concentration used, in % | Berger whiteness before exposure to light | Berger whiteness after exposure to light | Decrease in whiteness due to exposure to light |
|---|---|---|---|---|
| 3) | without whitener | 77.9 | 80.1 | — |
| 7a) | 0.084 | 96.6 | 94.1 | 2.5 |
| 7b) | 0.12 | 98.6 | 94.4 | 4.2 |
| 7c) | 0.18 | 106.8 | 100.8 | 6 |

Example 9

Whitened Polyamide 100 g of polyamide powder as in Example 6, 8 g of sodium dithionite, 12 g of ethoxylated nonylphenol (7–10 mol of ethylene oxide) and 1 g of the brightener of formula (5) (M=Na) are suspended in 4 l of demineralized water. Heating is carried out to the boiling point and stirring is carried out for 30 min at this temperature. After cooling to room temperature, the product is filtered off with suction and dried at 40° C. in a vacuum drying oven. The whitened polyamide powder exhibits a Berger whiteness of 154.3 and a CIE whiteness of 146.

Example 10

Dispersion of Whitened Polyamide

25% of the polyamide powder whitened according to Example 9 (1% of fixed brightener), 20% of emulsifier and 55% of water are dispersed at room temperature as described in Example 7. The resulting stable dispersion can be incorporated directly into the paper coating slip. Outstanding brightening effects with high lightfastnesses and fastnesses to bleeding are obtained.

Example 11

Whitened Polyester 100 g of polyester powder (polyethylene terephthalate, Agfa), 1 g of an anionic dispersant (®Avolan IS, Bayer), 2 g of auxiliary (Levegal PEW, Bayer) and 1 g of the whitener of the formula (7) ($R^6$=$R^7$=$CH_3$ and $X^1$=—CH═CH—) are suspended in 1 l of demineralized water. Heating is carried out to the boiling point and stirring is carried out for 60 min at this temperature. After cooling to room temperature, the product is filtered off with suction and dried at 40° C. in a vacuum drying oven. The whitened polyester powder shows a Berger whiteness of 147.3.

Example 12

Dispersion of Whitened Polyester

25% of the polyester powder whitened according to Example 11 (1% of fixed brightener), 20% of emulsifier (an ethoxylated biphenyl, emulsifier W from Bayer) and 55% of water are milled at room temperature and 1700 rpm for 90 min in a laboratory stirred ball mill filled with 290% of glass beads (0.4–0.52 mm diameter). After incorporation into paper coating slips, the resulting stable dispersion exhibits outstanding whitening effects with high lightfastness and very good fastness to bleeding.

Example 13

Whitened Polyester Dispersion

If the procedure described in Example 11 is followed but 1% of the whitener of formula (6)

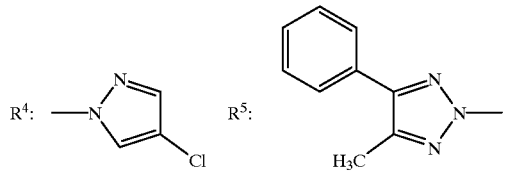

is added instead of 1% of the whitener of the formula (7) ($R^6$=$R^7$=$CH_3$ and $X^1$=—CH═CH—) and working up is carried out as described in Example 11, a polyester powder suitable for brightening paper coating slips is likewise obtained, which polyester powder gives, in the same way as described in Example 12, a stable pigment dispersion which can be readily incorporated into paper coating slips and gives therein outstanding whitening effects with very high lightfastness, high fastness to bleeding and a high greying limit.

What is claimed is:

1. A method for whitening a paper coating slip based on synthetic binders which comprises incorporating into said coating slip a whitened polyacrylonitrile powder having a weight-average particle size of less than 1 μm, or an aqueous suspension of said whitened polyacrylonitrile powder, wherein said polyacrylonitrile powder is whitened with a whitener selected from the group consisting of

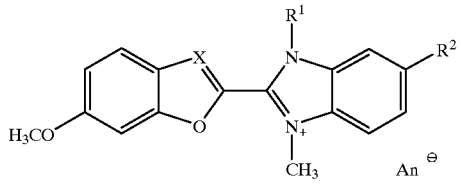

in which

X represents CH or N, $R^1$ represents $CH_3$ or $CH_2$—$C_6H_5$ and $R^2$ represents H or $SO_2$—$CH_3$; and

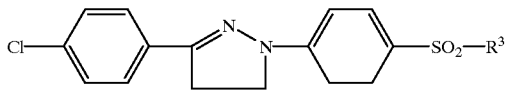

in which $R^3$ denotes $NH_2$, $CH_3$, NH—$C_3H_6$—$N(CH_3)_3{}^+An^-$, $C_2H_4$—$N(CH_3)_3{}^+An^-$, $CH_2$—$CH(CH_3)$—$N(CH_3)_3{}^+An^-$, $CH(CH_3)$—$CH_2$—$N(CH_3)_3{}^+An^-$, $C_2H_4O$—$CH(CH_3)$—$CH_2$—$N(CH_3)_3$+$An^-$ or $C_2H_4$—CO—NH—$C_3H_6$—$N(CH_3)_3{}^+An^-$ and $An^{\ominus}$ denotes the anion of a mineral acid, formic acid, acetic acid, lactic acid or $O_3SOCH_3$.

2. A paper coating slip based on synthetic binders which comprises a whitened polyacrylonitrile powder having a weight-average particle size of less than 1 $\mu$m, or an aqueous suspension of said whitened polyacrylonitrile powder, wherein said polyacrylonitrile powder is whitened with a whitener selected from the group consisting of

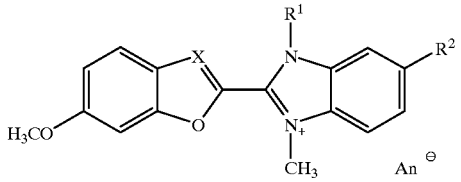

in which

X represents CH or N, $R^1$ represents $CH_3$ or $CH_2$—$C_6H_5$ and $R^2$ represents H or $SO_2$—$CH_3$; and

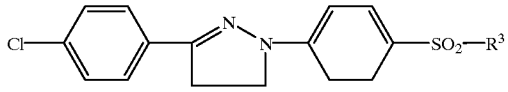

in which $R^3$ denotes $NH_2$, $CH_3$, NH—$C_3H_6$—$N(CH_3)_3{}^+An^-$, $C_2H_4$—$N(CH_3)_3{}^+An^-$, $CH_2$—$CH(CH_3)$—$N(CH_3)_3{}^+An^-$, $CH(CH_3)$—$CH_2$—$N(CH_3)_3{}^+An^-$, $C_2H_4$—O—$CH(CH_3)$—$CH_2$—$N(CH_3)_3$+ $An^-$ or $C_2H_4$—CO—NH—$C_3H_6$—$N(CH_3)_3{}^+An^-$ and $An^{\ominus}$ denotes the anion of a mineral acid, formic acid, acetic acid, lactic acid or $O_3SOCH_3$.

* * * * *